US005348170A

United States Patent [19]

Thornley et al.

[11] Patent Number: 5,348,170

[45] Date of Patent: Sep. 20, 1994

[54] FREE-STANDING SHELVING SYSTEM

[75] Inventors: Robert S. Thornley, Watford; Christos Papadopoulos, Tickhill, both of England

[73] Assignee: McKechnie (UK) Limited, West Midlands, United Kingdom

[21] Appl. No.: 963,291

[22] Filed: Oct. 19, 1992

[30] Foreign Application Priority Data

Oct. 17, 1991 [GB] United Kingdom ..... 9122087

[51] Int. Cl.[5] ..... A47F 5/00

[52] U.S. Cl. ..... 211/187; 108/107

[58] Field of Search ..... 211/187, 190, 192, 186; 248/243, 247; 108/106, 107, 111

[56] References Cited

U.S. PATENT DOCUMENTS

| | | | |
|---|---|---|---|
| 2,621,800 | 12/1952 | Neubauer | 211/186 X |
| 2,933,193 | 4/1960 | De Mattia | 211/187 X |
| 3,294,250 | 12/1966 | Evans . | |
| 3,879,144 | 4/1975 | Eckerbrecht | 211/187 X |
| 3,981,250 | 9/1976 | Anthony | 108/106 |
| 4,421,239 | 12/1983 | Vargo | 211/187 |

FOREIGN PATENT DOCUMENTS

| | | |
|---|---|---|
| 0172111 | 2/1986 | European Pat. Off. . |
| 1141135 | 1/1969 | United Kingdom . |
| 1155251 | 6/1969 | United Kingdom . |
| 1441065 | 6/1976 | United Kingdom . |
| 1448884 | 9/1976 | United Kingdom . |

*Primary Examiner*—Robert W. Gibson, Jr.
*Attorney, Agent, or Firm*—Wenderoth, Lind & Ponack

[57] ABSTRACT

A free-standing shelving system of the type comprising four uprights supports a plurality of rectangular shelves. Attachment of the shelves at each corner is to one of the uprights. Each shelf 5 is formed at each corner with a corner piece 12 which is shaped to define protruding bridge pieces 15, 16. An upright 4 is of generally W-section having a re-entrant portion formed by surfaces 21, 22 in which are formed holes 11 which are shaped and mutually spaced so as to receive the bridge pieces 15, 16. When the shelf is in place, the bridge pieces 15, 16 extend through to the exterior of the re-entrant portion, and this allows a peg 24 to be dropped into the longitudinal passageway thus defined to thereby firmly lock the assembly together.

10 Claims, 7 Drawing Sheets

27
24
25
26
17
23
22
17
18
19
11
21
4
11
18
20
5
7
7
13
15
8
9
29
29
12
14
16

FREE-STANDING SHELVING SYSTEM

BACKGROUND OF THE INVENTION

This invention relates to a free-standing shelving system.

Such shelving systems, which are commonly made from steel, comprise a plurality of uprights and a plurality of shelves which are supported at spaced positions on the uprights. A common basic configuration comprises four uprights supporting three or more rectangular shelves, the uprights being positioned to provide a support at each of the four corners of the shelves. Such a unit is free standing. Several such units can be attached together to form a run of shelving and, in some types, uprights may be shared between adjacent units.

Free standing shelving systems of this general type have been available for many years. Commonly they are supplied as kits which are bolted together to form the shelving. The uprights are equipped with a plurality of spaced holes so that the shelves can be position at any desired height, according to the requirements. The assembly of these shelves, involving as they do many nuts and bolts, is lengthy and awkward and recently attempts have been made to cut down on the assembly time of these systems. One recent system, for example, utilises shelf support clips which are fitted at desired positions on the uprights, and are shaped to support and secure the shelves.

In another system, described in British Patent No. 1441065, the uprights are formed with keyhole-shaped holes, and the shelves are supported on elongate shelf support members which are equipped with pegs which co-operate with the keyholes to provide a frame structure on which the shelves can be laid. The system has the disadvantage of requiring many components to produce even a basic set of shelves and, as such, has little advantage over the conventional nut and bolt system described above.

SUMMARY OF THE INVENTION

In the system of the present invention, however, the number of component parts needed to make a set of shelves is reduced to the minimum because neither bolts, or separate shelf supports, are required. Instead, according to the invention the shelves themselves are provided with attachment means which are co-operatively engageable with holes in said uprights. Such attachment means may for example take the form of the corners of the shelves themselves which, with suitably shaped uprights, can be arranged to protrude through the holes in the uprights. That part of the shelf corner which emerges through the hole is then locked in position by locking means. With each corner of each shelf secured in this way, it is possible to fabricate a free-standing shelving system which is both rigid and easy to adapt to changing circumstances. Assembly is very quick, since the only components required to make the basic unit are the uprights, the shelves and the locking means.

In its broadest aspect, the invention thus provides a shelving system comprising a plurality of uprights equipped with spaced holes therealong, a plurality of shelves, and means at each corner of each shelf for attaching said shelves to said uprights, each said attachment means comprising protrusion means at the corner of the shelf shaped such that, when the shelf is positioned as desired with respect to one of said uprights, said protrusion means protrudes through one or more of said holes in the upright, and locking means for locking the protrusion means in position with respect to the upright. Preferably the locking means is positioned on the exterior of the upright.

BRIEF DESCRIPTION OF THE DRAWINGS

In order that the invention may be better understood, two embodiments thereof will now be described by way of example only and with reference to the accompanying drawings in which.

DETAILED DESCRIPTION OF THE PREFERRED EMBODIMENTS

Figure 1:
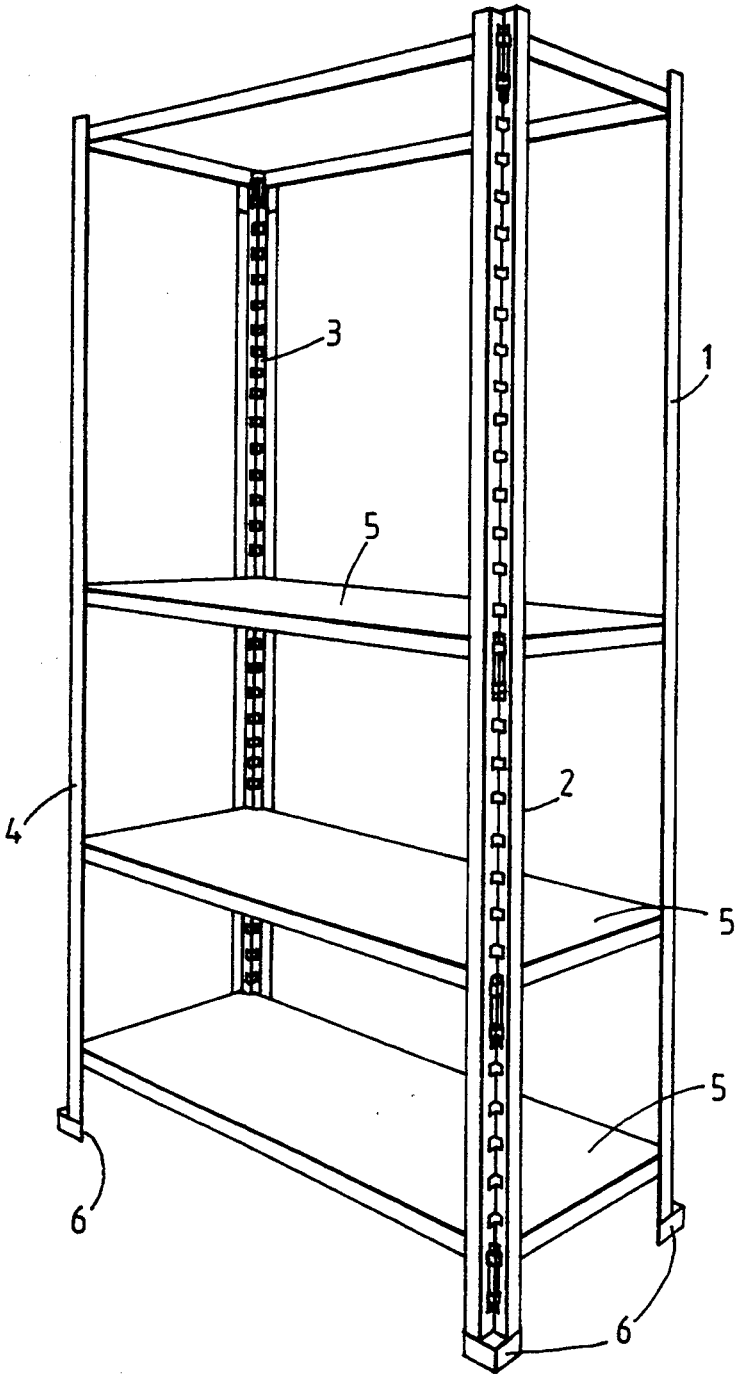
FIG. 1 is a pictorial perspective view showing a first embodiment of a shelving system according to the invention.

Referring first to FIG. 1, the shelving system illustrated comprises four uprights 1 to 4 which support a plurality of shelves 5. The uprights are equipped along their length with spaced holes so that the shelves can be fitted at a variety of positions, according to the circumstances of use. The basic shelving unit may be used simply as a basic shelving system, either alone or as part of a larger system, and may be free-standing or attached to an adjacent wall. Various additions may be made to enhance the product such as tool hooks, storage baskets, cupboard doors, and side and back panels (not shown). The bottoms of the uprights may be fitted with caps 6, as shown, to prevent damage to the floor surface.

Figure 2:
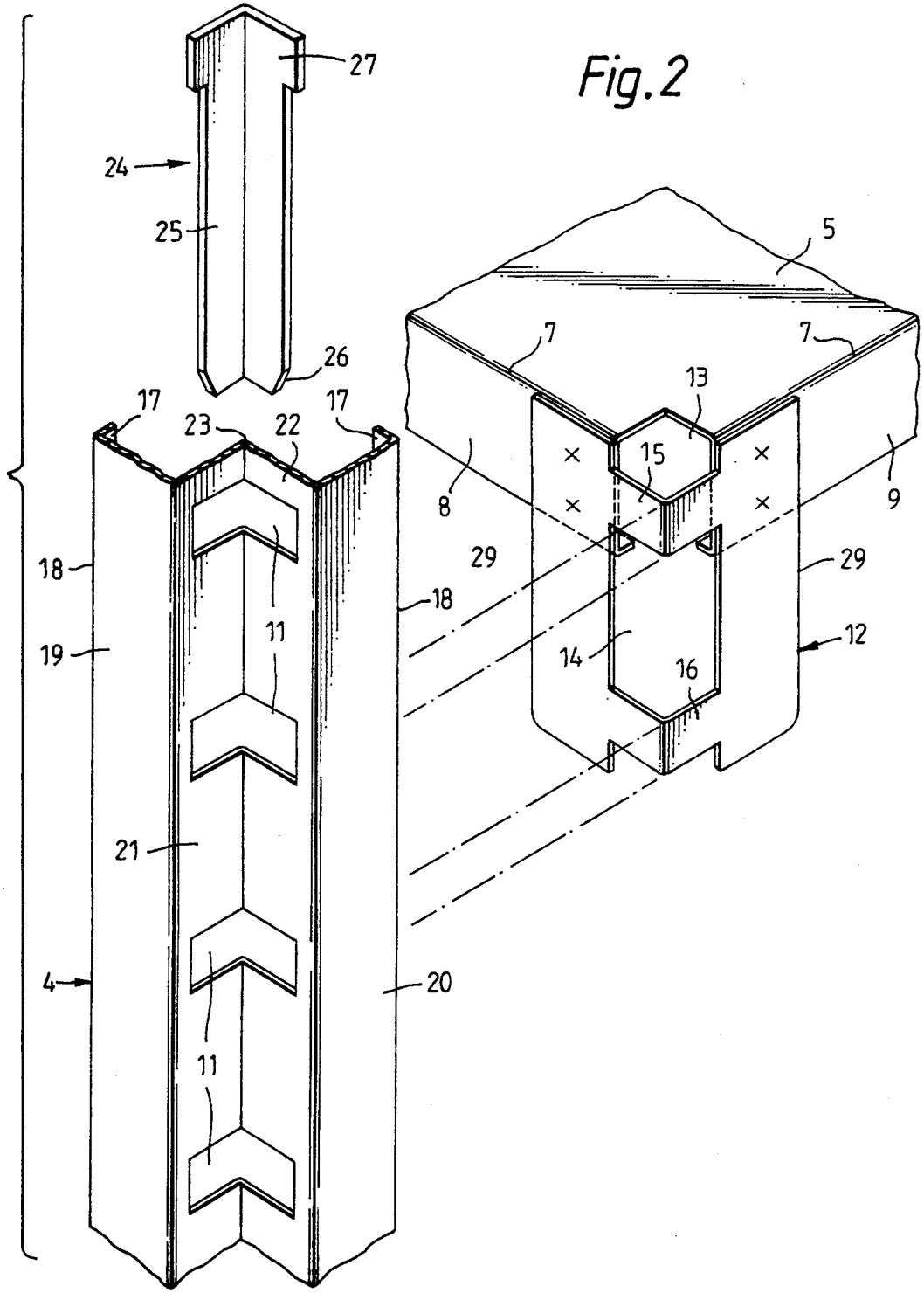
FIG. 2 is a perspective view of part of the shelving system of FIG. 1, in enlarged detail, and with parts separated.
Figure 3:
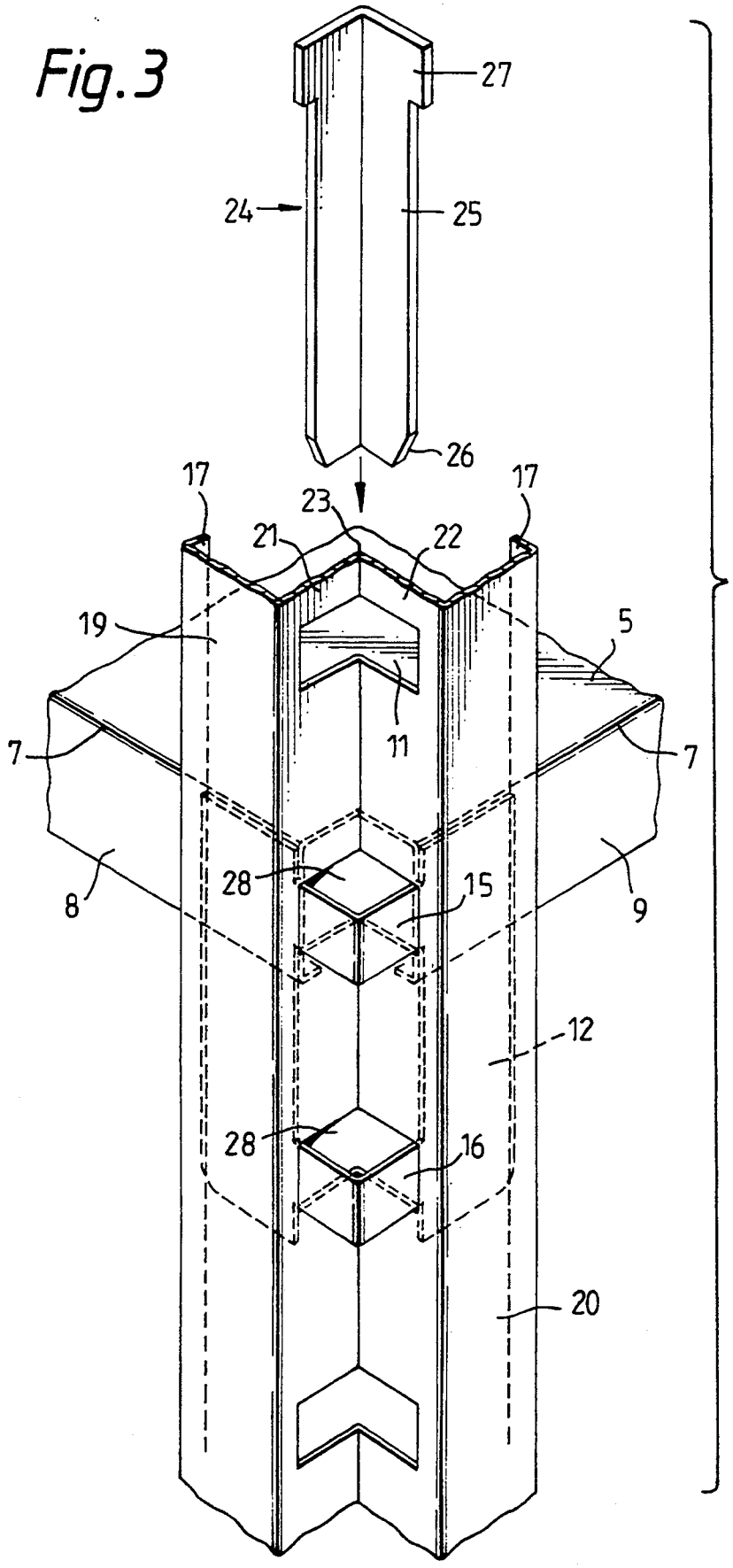
FIGS. 3 and 4 are perspective views of part of the shelving system of FIG. 1 showing stages in assembly.
Figure 4:
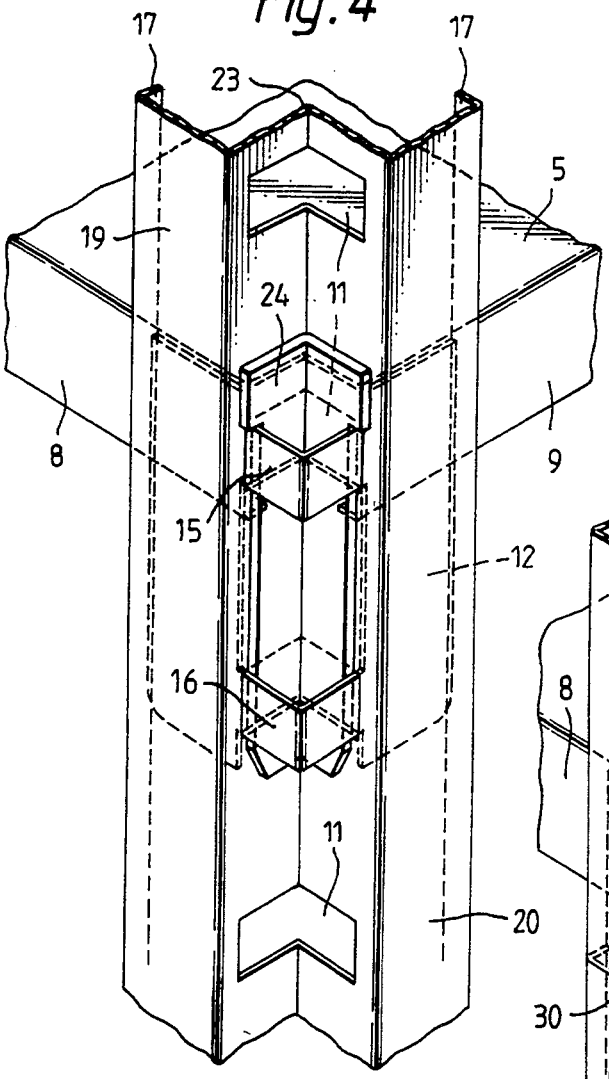

Reference is now made to FIGS. 2, 3 and 4 which show in further detail the first embodiment of the invention. The invention is directed to the problem of finding a rigid and secure fitting of each shelf 5 to the uprights 1 to 4. To illustrate this, just a single shelf 5 is shown in the following drawings, for clarity.

Each shelf comprises sheet material, for example steel, which initially has the corner shape illustrated in FIG. 4 but which, during manufacture, is folded along edges 7 to give perimeter flange portions 8, 9. The flanges 8, 9 serve to improve the load carrying capacity of the shelf whilst at the same time providing a convenient surface on which to provide the interengagement means by which the corner of the shelf is attached to the upright.

The uprights 1 to 4 each comprise angle section, for example also of steel, and are provided with a plurality of equally spaced holes 11 which form part of the interengagement means.

The interengagement means at each corner of each shelf will now be described in detail. The basic concept is to provide, at each corner of each shelf, protrusion means which protrudes through at least one hole 11 in an associated upright and locking means which locks the protrusion means in position, thus locking the corner of the shelf firmly to the upright.

Referring to FIG. 2, it will be seen that a separate corner piece 12, for example also of steel, has been attached for example by spot welding to the flanges 8, 9. At the same time, the material of the shelf itself is cut away at the corner, resulting in a square-shaped indentation 13 in order to clear the upright 4, as will become clear later. The corner piece 12 continues the shape of the corner which would be defined by flanges 8, 9, had they not been cut back. However the apex area of the corner piece is formed with an aperture 14, thus defining two separate bridge pieces 15, 16. It will be seen that the use of a separate corner piece 12 is not essential, since the shape defined could readily be formed by the material of the shelf itself. However, a separate corner piece welded to the two flanges 8 and 9 at the corner enables the corner to be strengthened by the joining of the flanges, and also enables the bridge pieces 15, 16 to be made stronger by the use of a heavier gauge material for the corner piece than that used for the rest of the shelf. Also, the use of a separate corner piece readily enables the lower bridge piece 16 to be formed without the need to extend downwardly at the corners the material of flanges 8 and 9, which latter results in a much larger material requirement for shelf 5. It will also be seen that, for particularly heavy duty requirements, three or more bridge pieces could be formed, the corner piece 12 being extended upwards or downwards or both, for this purpose.

The uprights are of approximately W-section, with narrow flanges 17 down the outside edges 18. Thus, each upright comprises first and second mutually orthogonal surfaces 19, 20 which, when the shelf is position, lie parallel to the flanges 8 and 9 respectively. The central part of the W section is formed with two further mutually orthogonal surfaces 21, 22. These latter surfaces do not have to meet at right angles, but it is convenient if they do.

The holes 11 in the uprights are formed partly in surface 21 and partly in surface 22, and extend across the edge 23 between the two surfaces, as shown. The holes are rectangular in shape and are sized to readily receive and locate the bridge pieces 15 and 16. The holes 11 are spaced apart along the length of the upright, and the bridge pieces 15, 16 are spaced apart by an amount corresponding to the spacing between the adjacent holes.

Assembly is commenced, from the position of the separated parts shown in FIG. 2, by first inserting the bridge pieces 15, 16 of corner piece 12 into two adjacent holes 11 at a desired height in an upright 4. During this operation, the edge 23 of surfaces 21, 22 enters the aforementioned indentation 13 in the shelf 5 and thus closes off the hole formed there. The parts are now in the position illustrated in FIG. 3.

In order to lock the parts in this position, an elongate peg 24 is used. The peg 24 has a shank portion 25, tapered at the bottom 26, and an enlarged head portion 27.

To lock the parts together, the peg is dropped down into the longitudinal aperture or passage 28 defined between the back surfaces of the bridge pieces 15, 16 and the exterior surfaces 21, 22 (see FIG. 3). The tapered portion 26 acts to guide the peg; the shank portion 25 is sized to be a close sliding fit in the passage 28 to thereby firmly lock the shelf to the upright. The head of the peg limits movement of the peg. The length of the shank portion is such that it extends by an amount sufficient to lock both of bridge pieces 15 and 16 to the upright 4. However, separate pegs could be used. The fully assembled corner is shown in FIG. 4.

Although shown of angle material, the pegs could be made in the solid, of round or rectangular (square) section, as desired. The peg material will depend upon such considerations as shape, durability, strength and appearance. If made of angle material, as shown, steel would be a suitable material; however, in some circumstances pegs made of plastics material might be preferable, as having an enhanced appearance. Also, it will be apparent that a single peg could be used to simultaneously lock several, or even all, of the shelves attached to an upright.

When in the assembled condition, flanges 17 act to space the sections 19 and 20 away from the flanges 8 and 9, to allow for the thickness of the corner piece 12. It is nevertheless advantageous to make the flanges 17 deep enough to maintain a space behind the sections 19, 20 top allow a small degree of spring in the assembly which acts to keep the parts firmly in position after placement of the peg 24. There is also advantage in making the corner piece 12 of such a size that its edges 29 locate closely within the flanges 17 to provide a snap action as the shelf corner is offered up to the upright. By relying on mechanical interaction between the edges 29 and the inside surfaces of flanges 17, increased rigidity can be achieved.

Figure 5:
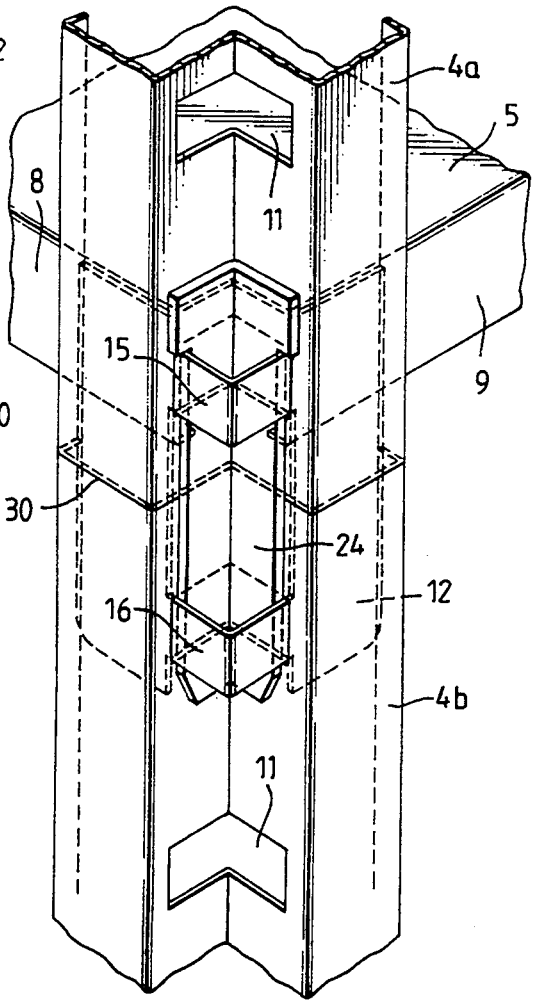
FIG. 5 is a view similar to FIG. 4 showing a method of connecting uprights together for greater height.

In the event that a shelving system is required that is taller than the height of a single upright, uprights can be joined together end to end by various means. A separate joining piece can be used for this purpose, but a particularly convenient method is illustrated in FIG. 5. FIG. 5 is largely self-explanatory, and illustrates the end to end joining of upper and lower uprights 4*a*, 4*b* by means of a joiner piece in the form of the corner piece 12 forming part of the shelf interengagement means, as described above. Reference 30 represents the abutment line of the two uprights 4*a*, 4*b*. The disadvantage of this method, over separate joining pieces, is that there is slightly less flexibility in the positioning of shelves.

Figure 6:
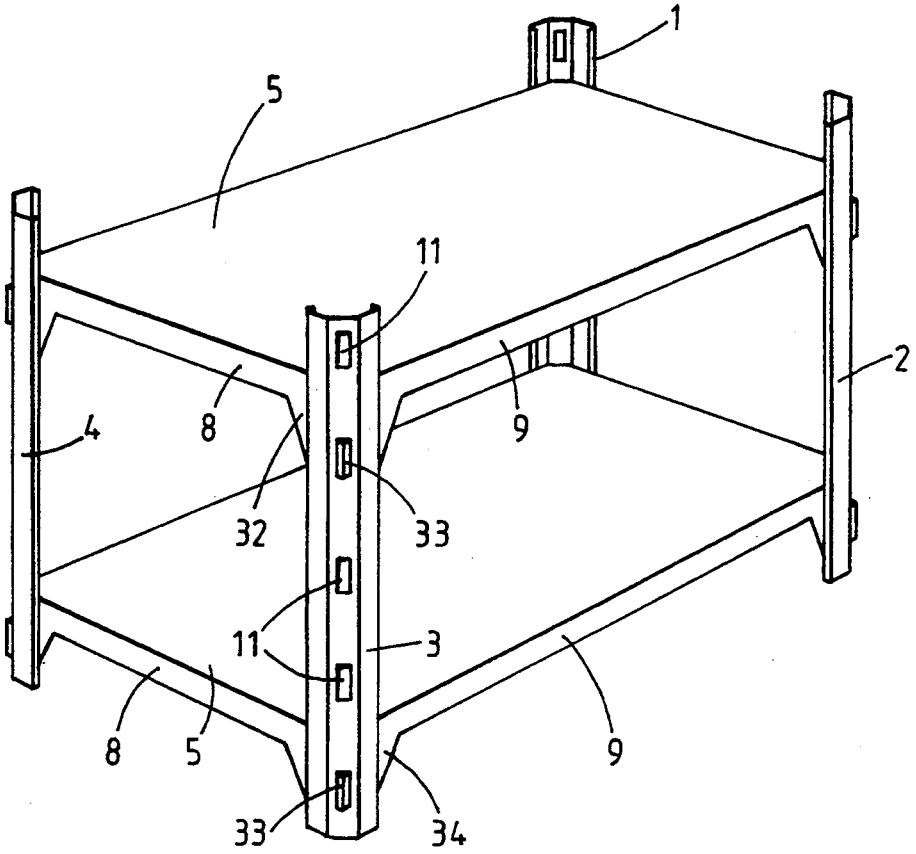
FIG. 6 is a pictorial perspective view of part of a shelving system, showing a second embodiment.
Figure 7:
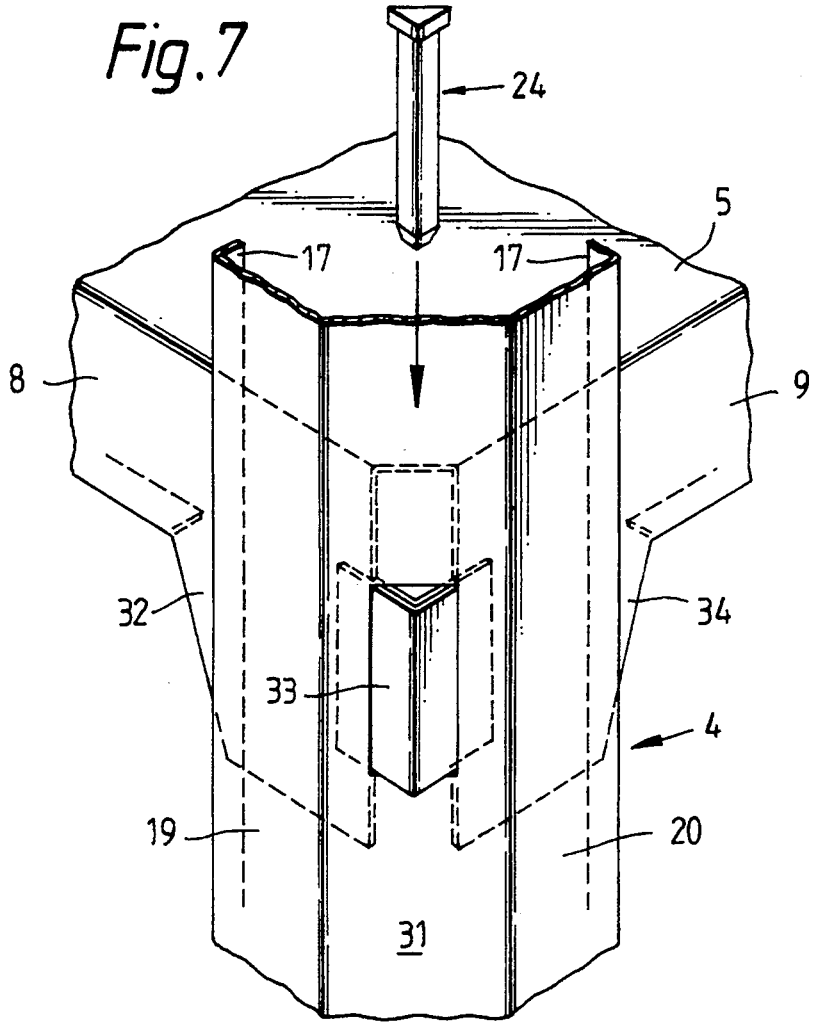
FIGS. 7 and 8 are perspective and plan views respectively showing part of the shelving system of FIG. 6, in enlarged detail.
Figure 8:
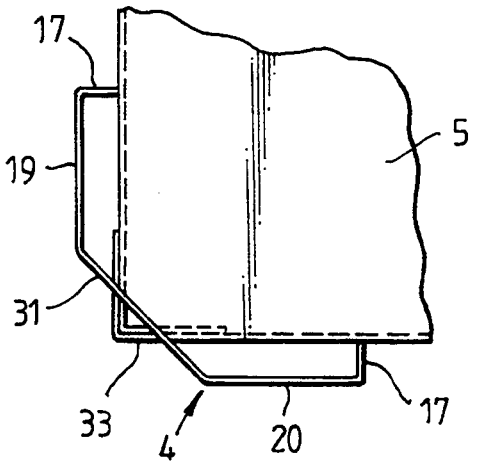

Reference is now made to FIGS. 6, 7 and 8, which show a second embodiment of the invention. In this embodiment, the sectional shape of the uprights is different: each upright comprises mutually orthogonal surfaces 19, 20, as before, which when fitted lie parallel with the shelf flanges 8 and 9 respectively. Extending between the surfaces 19, 20 and at an angle of 45° to each, is an intermediate surface 31 which is planar. A plurality of equally-spaced rectangular holes 11 are formed in the intermediate surface 31.

The corner of the top surface of shelf 5 is mitered to correspond to the internal shape of the upright. In addition, the flange portions 8 and 9 are both widened at the corner to form mutually orthogonal surfaces 32, 34 at each corner. At the corner itself, a single bridge piece 33 is formed out of the material of shelf 5. The bridge piece 33 is shaped in a similar manner to the bridge pieces 15, 16 of the first embodiment and is intended, as before, to protrude through one of the holes 11 to enable securement of the shelf concerned to the upright. Other details of this version are as described above with reference to FIG. 2, except that it will be noted that the shape of the indentation 13 is different, so as to conform to the different internal shape of the upright.

After assembling the corner of the shelf into upright - the position illustrated in FIG. 7 - a pin 24 is dropped down into the aperture 28 in the manner described previously in order to lock the assembly together. This pin is made of plastics material and has a shank with a triangular cross section. Although not shown, it is preferred that the lower end of pin 24 is tapered slightly to assist passage into the aperture 28. Also, the rear surface of the pin at the lower end is preferably chamfered to reduce the possibility of the peg catching on the lower edge of hole 11 as the pin is pushed in.

Figure 9:
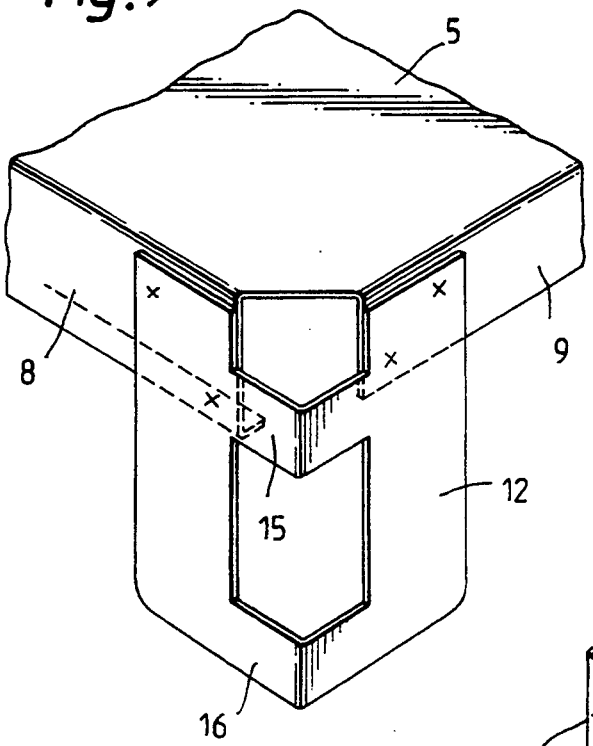
FIG. 9 is a perspective view showing shelf corner detail of a third embodiment.
Figure 10:
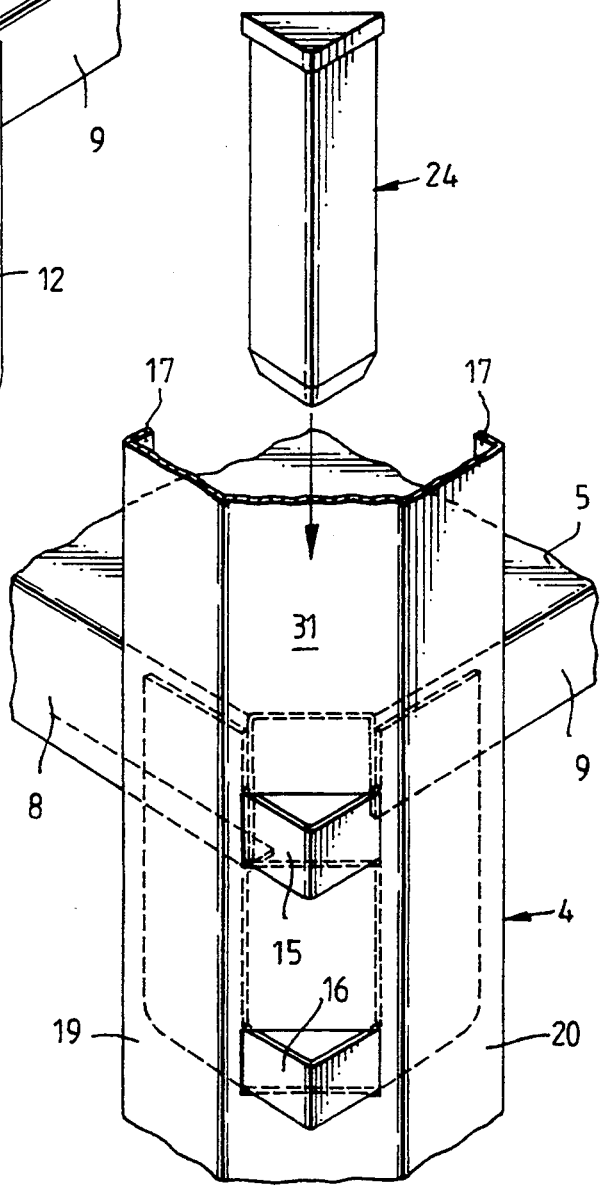
FIG. 10 is a view similar to FIG. 7, but showing the third embodiment.

Reference is now made to FIGS. 9 and 10 which show a third embodiment of the invention. The third embodiment is closely similar to that of FIGS. 6 to 8, except that a separate corner piece 12, somewhat in the manner of that shown in FIG. 2, is used in place of the arrangement shown in FIG. 7. The corner piece 12 of FIG. 7 comprises a pair of spaced bridge pieces 15,16 each of which enters a respective hole 11 in the upright. For this purpose, the holes 11 in the upright are longitudinally shorter than those shown in FIGS. 6 and 7; otherwise the uprights are the same.

The corner piece 12 is dimensioned so that its longitudinally-extending edges fit snugly inside the inturned flanges 17 formed on the upright. This feature generally increases the rigidity of the assembly.

There have been described three embodiments of shelving systems which can be assembled quickly and easily from a relatively small number of components. The assembled shelving units are strong and rigid and visually more attractive than the conventional shelving systems using nuts and bolts. Appearance can be further enhanced by covering the corners of the uprights, for example with a clip-on strip with a decorative outer surface. Although the drawings show the holes 11 provided along the length of the uprights, this is not of course essential. It may be desirable for aesthetic or cost reasons, or under special circumstances, to place holes 11 only where a shelf is to be put, thus restricting the positioning of shelves 5.

We claim:

1. A free-standing shelving system, comprising:

a plurality of uprights having spaced holes therealong;

a plurality of shelves having exterior surfaces;

an attachment arrangement attaching said shelves to said uprights so that said shelves can extend approximately horizontally between said uprights and be supported thereby, said attachment arrangement comprising a separate corner piece attached at each corner of each said shelf on the exterior surface thereof such that said corner piece projects outwardly from the exterior surface of said shelf, and each said corner piece extending longitudinally in a direction substantially perpendicular to said shelf and having a protrusion protruding through one of said holes in said uprights; and locking members locking said protrusion in said holes of said uprights;

wherein said uprights have exterior edges with longitudinal flanges thereon, said longitudinal flanges being positioned about said separate corner pieces projecting outwardly from the exterior surfaces of said shelves such that said corner pieces are held substantially rigid with respect to said uprights.

2. The system of claim 1, wherein said exterior surface of each said shelf is on a shelf flange, and said corner pieces are attached to said shelf flanges such that edges of said corner pieces are abutted by said longitudinal flanges of said uprights, said longitudinal flanges further abutting said shelf flanges.

3. The system of claim 1, wherein said protrusions on said corner pieces define, together with said uprights, substantially longitudinal passages on the exterior of said uprights, and wherein said locking members comprise pins extending into said passages with a close fit therein.

4. The system of claim 3, wherein one of said pins extends along one of said uprights through a plurality of said longitudinal passages.

5. The system of claim 1, wherein said uprights have a cross-section, taken along a substantially horizontal plane, which positions said holes thereof such that said protrusions of said corner pieces protrude through said holes outwardly of said uprights.

6. The system of claim 5, wherein said shelves have sides extending to said corners thereof such that said sides approach each other at said corners at specified angles, and said uprights each comprises a portion that, if said sides were extended to meet at said corners at said specified angles, would cut across said sides at said corners of said shelves, said holes of said uprights being located in said portions of said uprights.

7. The system of claim 6, wherein said portions of said uprights are planar and extend at an angle of approximately 45° relative to said sides of said shelves.

8. The system of claim 6, wherein said portions of said uprights each comprises two planar portions connected at a longitudinal join at an angle of approximately 90°.

9. The system of claim 8, wherein said holes of said uprights are each formed in said two planar portions of one of said portions of said uprights and across said longitudinal join between said two planar portions.

10. The system of any one of claims 1–9 and further comprising covers attached to said uprights covering said attachment arrangements and said locking members.

* * * * *